US011282431B2

(12) United States Patent
Berget et al.

(10) Patent No.: US 11,282,431 B2
(45) Date of Patent: Mar. 22, 2022

(54) SYSTEM AND METHOD FOR DISPLAY COMPENSATION

(71) Applicant: SYNAPTICS INCORPORATED, San Jose, CA (US)

(72) Inventors: Damien Berget, Sunnyvale, CA (US); Joseph Kurth Reynolds, San Jose, CA (US)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 16/659,257

(22) Filed: Oct. 21, 2019

(65) Prior Publication Data

US 2020/0193892 A1 Jun. 18, 2020

Related U.S. Application Data

(60) Provisional application No. 62/779,941, filed on Dec. 14, 2018.

(51) Int. Cl.
*G09G 3/20* (2006.01)
*G09G 3/36* (2006.01)

(52) U.S. Cl.
CPC ..... *G09G 3/2003* (2013.01); *G09G 3/2074* (2013.01); *G09G 3/3607* (2013.01); *G09G 3/3614* (2013.01); *G09G 2300/0452* (2013.01); *G09G 2340/0457* (2013.01)

(58) Field of Classification Search
CPC .. G09G 3/2003; G09G 3/2074; G09G 3/3607; G09G 3/3614; G09G 2300/0452; G09G 2340/0457
See application file for complete search history.

(56) References Cited

U.S. PATENT DOCUMENTS

| | | | | |
|---|---|---|---|---|
| 9,082,370 | B2 * | 7/2015 | Shiraishi | G09G 3/20 |
| 2011/0103698 | A1 * | 5/2011 | Hayashi | G06K 9/4652 382/201 |
| 2014/0104469 | A1 * | 4/2014 | Kim | H04N 5/378 348/297 |
| 2016/0343301 | A1 * | 11/2016 | Choi | G09G 3/3208 |
| 2018/0218690 | A1 * | 8/2018 | Zhou | G09G 3/3406 |
| 2020/0166863 | A1 * | 5/2020 | Noro | G03G 15/04054 |

* cited by examiner

*Primary Examiner* — Patrick N Edouard
*Assistant Examiner* — Eboni N Giles
(74) *Attorney, Agent, or Firm* — Ferguson Braswell Fraser Kubasta PC

(57) ABSTRACT

A system and method for updating a display of a display device. The display device may include a plurality of subpixels, and a display driver coupled to the plurality of subpixels. The display driver may be configured to compare a first data signal of a first statistically selected subpixel of the plurality of subpixels to a first statistically selected threshold, increase a value of a first counter corresponding to the first statistically selected subpixel in response to the first subpixel data signal exceeding the first statistically selected threshold, adjust the first subpixel data signal in response to the first counter value satisfying a second threshold, and drive the first statistically selected subpixel based at least in part on the adjusted first subpixel data signal.

20 Claims, 7 Drawing Sheets

| | | | | | | | | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|---|
| CODE | 1 | 37 | 52 | 61 | 67 | 73 | 78 | 82 | 85 | 89 | 92 | 95 | 98 | 100 | 103 | 105 | 107 | 109 | 111 | 113 | 115 | 117 | 119 | 120 | 122 | 124 | 125 | 127 | 128 | 130 | 131 | 132 | 134 | 135 | 136 | 138 | 139 | 140 |
| SELECTIONS | 0 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| NUMBER OF COUNTS | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 | 37 |
| CODE | 140 | 142 | 144 | 145 | 146 | 147 | 148 | 149 | 150 | 151 | 152 | 153 | 154 | 155 | 156 | 157 | 158 | 159 | 160 | 161 | 162 | 163 | 164 | 165 | 166 | 167 | 168 | 169 | 170 | 171 | 172 | 173 | 174 | 175 | 176 | 177 | 178 | 179 |
| SELECTIONS | 1 | 1 | 1 | 1 | 1 | 1 | 1 | 1 | 1 | 1 | 1 | 1 | 1 | 1 | 1 | 1 | 1 | 1 | 1 | 1 | 2 | 1 | 1 | 1 | 2 | 1 | 1 | 1 | 2 | 1 | 1 | 1 | 2 | 1 | 2 | 1 | 1 | 2 |
| NUMBER OF COUNTS | 38 | 39 | 40 | 41 | 42 | 43 | 44 | 45 | 46 | 47 | 48 | 49 | 50 | 51 | 52 | 53 | 54 | 55 | 56 | 58 | 59 | 60 | 61 | 62 | 64 | 65 | 66 | 67 | 69 | 70 | 71 | 72 | 74 | 75 | 77 | 78 | 79 | 81 |
| CODE | 180 | 181 | 182 | 183 | 184 | 185 | 186 | 187 | 188 | 189 | 190 | 191 | 192 | 193 | 194 | 195 | 196 | 197 | 198 | 199 | 200 | 201 | 202 | 203 | 204 | 205 | 206 | 207 | 208 | 209 | 210 | 211 | 212 | 213 | 214 | 215 | 216 | 217 |
| SELECTIONS | 1 | 2 | 1 | 2 | 1 | 2 | 1 | 2 | 1 | 2 | 2 | 1 | 2 | 2 | 1 | 2 | 2 | 2 | 1 | 2 | 2 | 2 | 2 | 2 | 2 | 2 | 1 | 2 | 2 | 2 | 2 | 3 | 2 | 2 | 2 | 2 | 2 | 2 |
| NUMBER OF COUNTS | 82 | 84 | 85 | 87 | 88 | 90 | 91 | 93 | 94 | 96 | 98 | 99 | 101 | 103 | 104 | 106 | 108 | 110 | 111 | 113 | 115 | 117 | 119 | 121 | 123 | 125 | 126 | 128 | 130 | 123 | 134 | 137 | 139 | 131 | 143 | 145 | 147 | 149 |
| CODE | 218 | 219 | 220 | 221 | 222 | 223 | 224 | 225 | 226 | 227 | 228 | 229 | 230 | 231 | 232 | 233 | 234 | 235 | 236 | 237 | 238 | 239 | 240 | 241 | 242 | 243 | 244 | 245 | 246 | 247 | 248 | 249 | 250 | 251 | 252 | 253 | 254 | 255 |
| SELECTIONS | 3 | 2 | 2 | 2 | 3 | 2 | 2 | 3 | 2 | 2 | 3 | 2 | 3 | 2 | 3 | 2 | 3 | 3 | 2 | 3 | 3 | 2 | 3 | 3 | 3 | 2 | 3 | 3 | 3 | 3 | 3 | 3 | 3 | 3 | 3 | 3 | 3 | 3 |
| NUMBER OF COUNTS | 152 | 154 | 156 | 158 | 161 | 163 | 165 | 168 | 170 | 172 | 175 | 177 | 180 | 182 | 185 | 187 | 190 | 193 | 195 | 198 | 201 | 203 | 206 | 209 | 212 | 214 | 217 | 220 | 223 | 225 | 229 | 232 | 235 | 238 | 241 | 244 | 247 | 250 |

FIG. 7

SYSTEM AND METHOD FOR DISPLAY COMPENSATION

CROSS-REFERENCE TO RELATED APPLICATIONS

This application claims priority to U.S. Provisional Patent Application Ser. No. 62/79,941, filed Dec. 14, 2018, which is incorporated by reference herein in its entirety.

BACKGROUND

Field

The disclosure herein generally relates to display devices, and more specifically, to updating display devices.

Description of the Related Art

Over time, display devices may experience variations in their operating parameters. These variations may reduce the performance of the display device. For example, the longer that a display device is used, the brightness of the display device may decrease due changes in the materials of the display device. The decrease in brightness may be visible to a user of the device, and may result in a non-uniform brightness of the display, where some pixels to be brighter than others. Further, the non-uniform brightness may result in visible defects within a displayed image.

Thus, there is a need for an improved method for correcting for a change in the operating parameters of a display device

SUMMARY

In one embodiment, a method for updating a display device comprises comparing a first subpixel data signal of a first statistically selected subpixel of a plurality of subpixels of the display device to a first statistically selected threshold, increasing a value of a first counter corresponding to the first statistically selected subpixel in response to the first subpixel data signal exceeding the first statistically selected threshold, adjusting the first subpixel data signal in response to the first counter value satisfying a second threshold, and driving the first statistically selected subpixel based at least in part on the adjusted first subpixel data signal.

In one embodiment, a processing system for a display device. The processing system comprises display driver circuitry and the processing system is configured to compare a first subpixel data signal of a first statistically selected subpixel of a plurality of subpixels of the display device to a first statistically selected threshold, increase a value of a first counter corresponding to the first subpixel in response to the first subpixel data signal exceeding the first statistically selected threshold, adjust the first subpixel data signal in response to the first counter value satisfying a second threshold, and drive the first statistically selected subpixel based at least in part on the adjusted first subpixel data signal.

In one embodiment, a display device comprises a plurality of subpixels and a display driver coupled to the plurality of subpixels. The display driver is configured to compare a first subpixel data signal of a first statistically selected subpixel of the plurality of subpixels to a first statistically selected threshold, increase a value of a first counter corresponding to the first subpixel in response to the first subpixel data signal exceeding the first statistically selected threshold, adjust the first subpixel data signal in response to the first counter value satisfying a second threshold, and drive the first statistically selected subpixel based at least in part on the adjusted first subpixel data signal.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

FIG. 7 illustrates a table to display and counter values, according to one or more embodiments.

Figure 1:
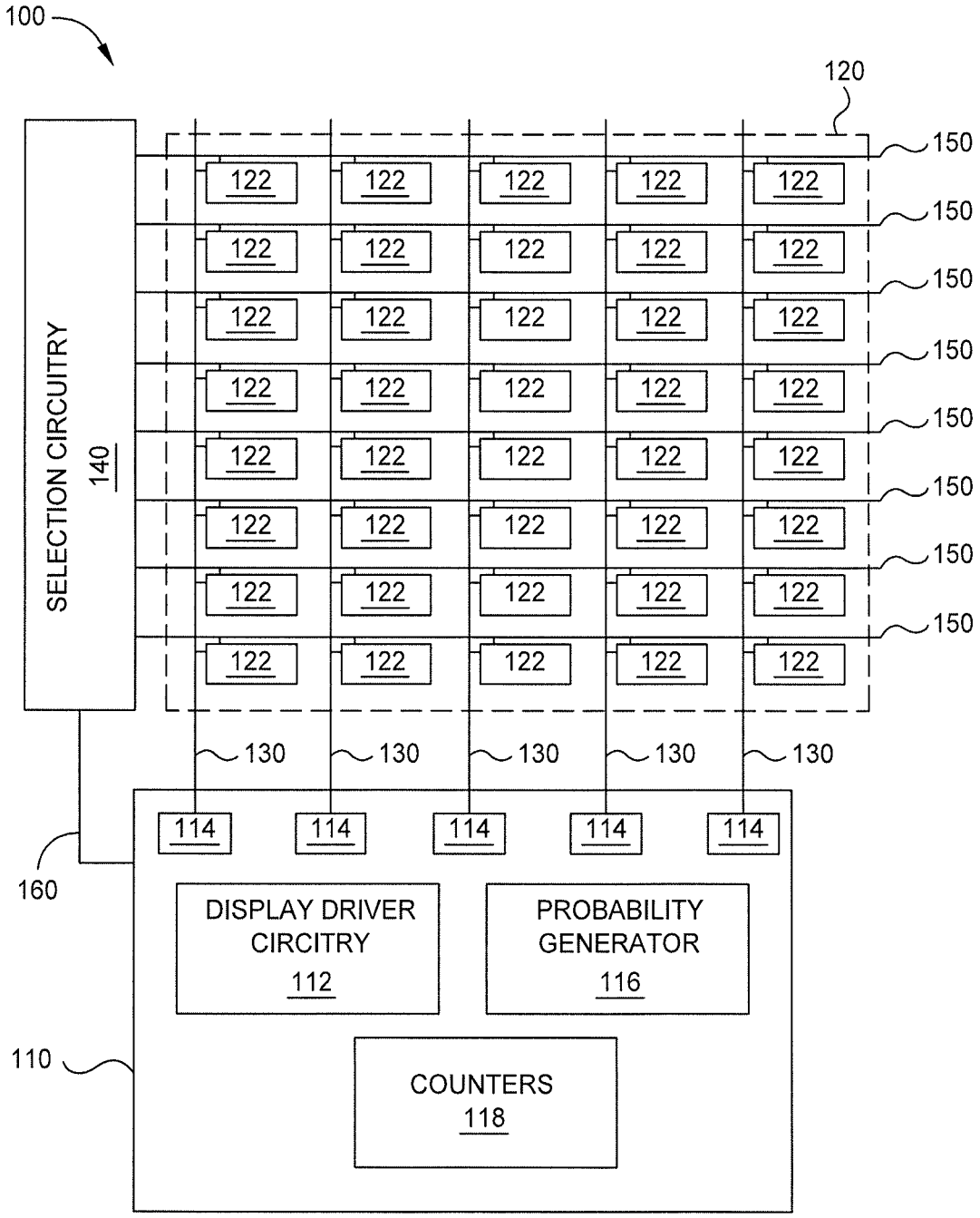
FIG. 1 is a schematic block diagram of a display device, according to one or more embodiments.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

FIG. 1 illustrates a display device 100. In one embodiment, the display device 100 includes a display driver 110 and a display panel 120. In one embodiment, the display driver 110 may be coupled to and configured to update an image displayed on the display panel 120.

The display panel 120 of FIG. 1 may include subpixels 122, gate lines 150 and data lines 130. In one embodiment, the display panel 120 includes over 3 million subpixels (e.g. full high definition (FHD) 1080 columns by 1920 rows with 2 subpixels per column row). In other embodiments, the display panel 120 includes at least 10 million subpixels, or about 24 million subpixels. The subpixels 122 may include red subpixels, green subpixels, and blue subpixels. In one embodiment, the subpixels 112 may include red subpixels, green subpixels, blue subpixels, and white subpixels. In other embodiments, other subpixel colors may be utilized.

Various orderings, e.g., layouts, of the subpixels 122 may be utilized. For example, the subpixels 122 may be configured such that each pixel comprises subpixel layout of a red subpixel, a green subpixel, and a blue subpixel. A subpixel layout consisting of a red subpixel, a green subpixel and a blue subpixel may be referred to as an RGB (red green blue) subpixel layout. Alternatively, the subpixels 122 may be configured such that each pixel comprises a subpixel layout of a red subpixel, a green subpixel, a blue subpixel, and a green subpixel. Further, the subpixels 122 may be configured such that each pixel comprises a subpixel layout of a red subpixel, green subpixel, a green subpixel, and a blue subpixel. Subpixel layouts consisting of a red subpixel, a green subpixel, a blue subpixel, and a green subpixel or a red subpixel, green subpixel, a green subpixel, and a blue subpixel may be referred to as subpixel rendering (SPR) patterns. The SPR subpixel layouts allow for a reduced number of subpixels within the display panel 120 without negatively affecting the visible resolution (e.g. the spatial resolution of the luminance may remain the same while the less visible chroma resolution is reduced) of a display panel.

Each subpixel 122 is coupled to a gate line (e.g., gate electrode) 150 and a data line (e.g., data or source electrode) 130. In one embodiment, the gate lines 150 are coupled to one or more subpixels 122 arranged in a common row. In one or more embodiments, at least two gate lines 150 are coupled to a subpixel of a common row. In various embodiments, the subpixels 122 forming a row may be referred to as a display line. In one or more embodiments, the display rows and columns may form a "zig-zap" pattern to ensure that the fill density of the subpixels is uniform.

Each of the data lines 130 is coupled to a column of subpixels. In one embodiment, each of the data lines 130 is coupled to each subpixel of a common column of subpixels. In many embodiments, respective ones of the gate lines 150 and respective ones of the data lines 130 cross one another at each display line. Further, connections between each subpixel 122 and a respective gate line 150 and/or a respective a data line 130 may alternate on either side of a common column or display row. In one or more embodiments, a connection between one or more subpixels 122 and a gate line 150 may cross one or more other gate lines 150.

In various embodiments, the display panel 120 is an organic light emitting diode (OLED) display. In other embodiments, the display panel 120 may be other types of displays. For example, the display panel 120 may be one of an light emitting diode (LED), cathode ray tube (CRT), liquid crystal display (LCD), plasma, electroluminescence (EL), micro OLED, or other display technology.

Figure 2:
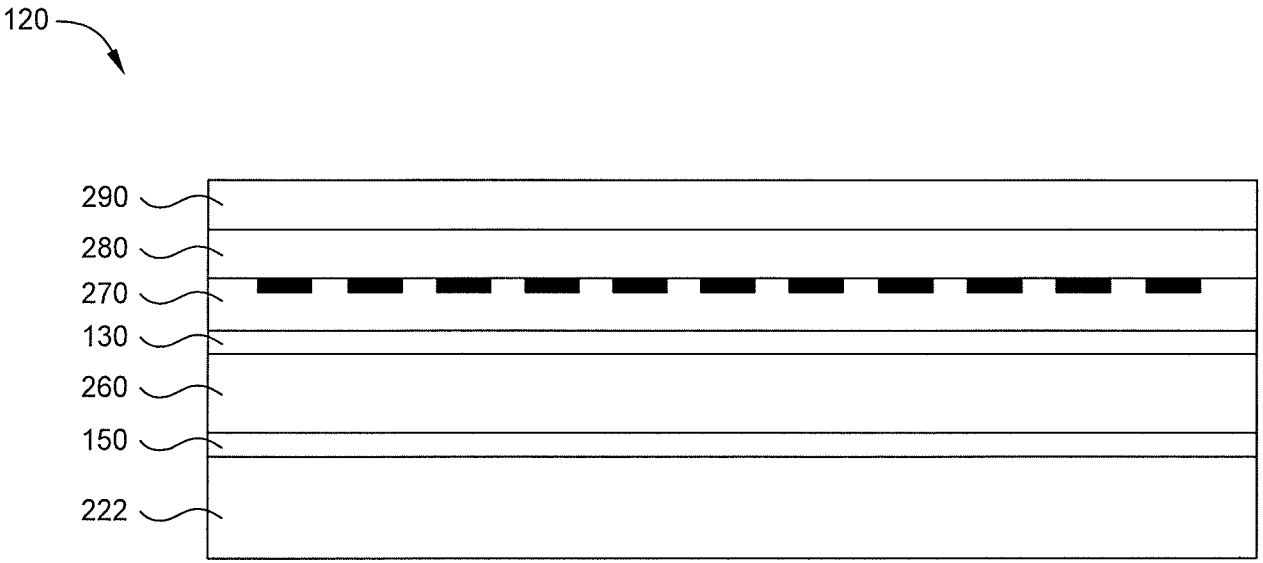
FIG. 2 is a side view of a portion of an example display device, according to one or more embodiments.

FIG. 2 is an example partial side view of the display panel 120. In the illustrated embodiment, the display panel 120 is an OLED display device and includes a substrate 222, gate lines 150, data lines 130, subpixel circuitry 260, anode electrodes 270, organic layers 280, and cathode electrode 290. In one embodiment, gate lines 150 and data lines 130 may be disposed within different metal layers of the display panel 120, and the position of those metal layers may differ from what is shown in FIG. 2. For example, in different embodiments, the gate lines 150 may be deposed in a metal layer either above or below the metal layer of data lines 130.

The substrate 222 may be a glass substrate or a plastic substrate. In one embodiment, the substrate 222 is substantially rigid. In other embodiments, the substrate 222 is at least partially flexible. In one or more embodiments, the display elements (e.g., the gate lines 150, the data lines 130, etc.) may be patterned and manufactured on a rigid substrate and removed from the rigid substrate before implementation within a display panel 120.

Each subpixel 122 includes subpixel circuitry 260. In one or more embodiments, each subpixel 122 comprises one or more transistors configured to control the activation and deactivation of each subpixel 122 and current flow through each subpixel 122 to update the subpixels 122. The subpixel circuitry 260 for each subpixel is coupled to a corresponding gate line 150, data line 130, and anode electrode 270. Further, the subpixel circuitry 260 may be configured to control the amount of current driven onto a corresponding anode electrode 270.

In various embodiments, the display panel 120 may include additional electrodes such as power supply electrodes, and/or emission control electrodes. The power supply electrodes may supply one or more power supply voltages to the display panel 120. Further, each of the emission control electrodes may be coupled to respective one of the subpixels 122 and is configured to control an emission period (e.g., period during which the subpixel emits light). In one embodiment, the emission control electrodes may be disposed parallel to the gate lines 150. Further, the emission control electrodes may be controlled by a clocked shift register. In one or more embodiments, switches may connect and disconnect the subpixels 122 of the display device to the emission control electrodes utilizing pulse width modulation (PWM). For example, a PWM signal may be driven on an emission control signal to control the duty cycle of the emission period of the corresponding OLEDs of the display panel 120.

The cathode electrode 290 may be a solid sheet of resistive material that overlaps one or more of the subpixels 122 and corresponding anode electrode 270. For example, in one embodiment, the display panel 120 includes a single cathode electrode 290 that is disposed over each of the subpixels 122. The cathode electrode 290 may be a resistive sheet having a resistance of about 1 to about 10 ohms per square. The cathode electrode 290 may be coupled with and driven by the display driver 110 or a power management integrated circuit (PMIC). In one embodiment, the difference in voltage on the cathode electrode 290 and the anode electrode 270 corresponds to the amount of light that is emitted by each of the subpixels 122. Further, the amount of light that is emitted by each of the subpixels 122 may non-linearly correspond to the difference in voltage between the cathode electrode 290 and the anode electrode 270. In one or more embodiments, a current source may be utilized to drive the voltage difference between the anode and cathode electrodes. Further, the cathode electrode 290 is separated from the anode electrode 270 by one or more organic layers 280, forming the OLEDs.

The display driver 110 may be configured to update display panel 120. In one embodiment, the display driver 110 drives data signals onto the data lines 130 to update the subpixels 122. The display driver 110 may include parts of or all of one or more integrated circuit (IC) chips and/or other circuitry components.

In one embodiment, the display driver 110 includes display driver circuitry 112 and source drivers 114. The display driver 110 may additionally include one or more PMICs, gate driver circuitry, emission control driver circuitry, image processing circuitry, a frame buffer, a DeMura buffer, white point control circuitry (e.g., gamma control circuitry, DeMura circuitry, etc.), and display data receiver (e.g., Mobile Industry Processor Interface (MIPI) circuitry, Display Port circuitry, or the like). Each of the source drivers 114 may be coupled to one or more subpixels 122 via data lines 130. For example, each anode electrode 270 of the subpixels 122 may be coupled to one of the data lines 130, such that the anode electrode 270 may be driven to an associated one of the source drivers 114. In one embodiment, each of the source drivers 114 is coupled to one or more columns of subpixels 122.

The display driver 110 may be configured to update the subpixels 122 to update an image displayed on the display panel 120 during each display frame. The display frames may be updated, or refreshed, once about every 16 ms, generating a display refresh rate of 60 Hz. In other embodiments, other display refresh rates may be employed. For example, the display refresh rate may be 90, 120 Hz, 240 Hz, or utilized. For example, display refresh rates of 90 Hz, 120 Hz, 180 Hz, and 240 Hz, among others, may be utilized. In one embodiment, each display frame may include one or more subframes. Further, each display frame may include one or more display dynamic rows for brightness control. The display dynamic rows may be controlled by apply PWM to the emission control electrodes such that the display dynamic rows scan at a multiple of the display refresh rate. For example, the display dynamic rows may scan at 60 Hz, 120 Hz, 240 Hz, and/or 480 Hz.

The display driver 110 may generate timing signals such as a vertical sync (VSYNC) signal to start and/or end a display frame. In one embodiment, the VSYNC signal is provided to selection circuitry 140 via communication path 160 to provide an indication to the selection circuitry 140 to begin selection of the gate lines 150 and subpixels 122 for display updating. In one embodiment, the VSYNC signal may additionally or alternatively identify one or more vertical blanking periods within a display frame.

The display driver 110 may be configured to generate a timing signal such as a horizontal sync (HSYNC) signal that corresponds to the start of a display line update period and/or to an end of a display line update period. The display driver 110 may output HSYNC signal to selection circuitry 140 via a communication path 160 to control selection and de-selection of the gate lines 150. In one embodiment, the horizontal sync signal may additionally or alternatively identify one or more blanking periods that correspond to a display line update period. Further, the horizontal sync signal may allow for at least a substantially constant voltage update settling across the display panel 120.

In one embodiment, the display driver 110 utilizes a timing signal such as a display enable signal that may be a composite signal of both the HSYNC and VSYNC signals, and may identify the start time of a display frame, an end time of a display frame, horizontal blanking periods corresponding to a display line update period, and/or vertical blanking periods within a display frame.

In one or more embodiments, the timing signals may be generated by the display driver 110 (e.g., in a command mode) from display data stored within a display frame buffer. Further, the timing signals may be generated by the display driver 110 from an display signal (e.g., a MIPI signal) when operating in video mode. In a video mode, the display data may bypass the frame buffer. In one or more embodiments, the operating mode of the display device 100 may switch between video mode and image mode and/or between a sleep-in mode and sleep-out mode.

In one embodiment, the selection circuitry 140 is configured to drive gate select and gate deselect signals on to the gate lines 150 to select (active) and deselect (deactivate) the subpixels 122 for updating. The gate select signal may be referred to a gate high signal or $V_{GH}$ and the gate de-select signal may be referred to a gate low signal or $V_{GL}$. In one embodiment, $V_{GH}$ is a positive voltage and $V_{GL}$ is a negative voltage. In other embodiments, $V_{GH}$ and $V_{GL}$ correspond to the turn-on and turn-off voltages of the transistors of the subpixels configured to control activation and deactivation of the subpixels. In one example embodiment, $V_{GH}$ is about 15 V and $V_{GL}$ is about −10 V. However, in other embodiments, other voltages may be used.

In one or more embodiments, the subpixel data signals are between about −2 V and about 8 V. However, in other embodiments the subpixel data signals may be less than −2 V or greater than 8 V. Further, the cathode electrode 290 may be driven to a voltage between about 0 V to about 2 V. In other embodiments, the cathode electrode 290 may be driven to voltages less than 0 V or greater than 2 V. Further, the power supply voltage for the display device 100 may be in a range of about 6 V to about 8 V. In other embodiments, the power supply voltage for the display device 100 may be less than 6 V or greater than 8 V.

In one embodiment, the subpixel circuitry 260 for a subpixel 122 is configured to couple a corresponding anode electrode 270 with the subpixel data signal on a corresponding the data line 130. Further, the subpixel circuitry 260 for a subpixel 122 may be configured to couple a corresponding anode electrode 270 with an initialization voltage before coupling a corresponding anode electrode 270 with the subpixel data signal. In one or more embodiments, the subpixel circuitry 260 may compensate for threshold voltage offsets and other manufacturing or processing variable effects.

In one or more embodiments, each of the subpixels 122 selected for updating by selection circuitry 140 may be driven with a subpixel data signal by the display driver 110 via a corresponding one of data lines 130. In one embodiment, the subpixel data signal is a voltage signal.

In one embodiment, the display driver circuitry 112 is configured to process display data to generate subpixel data signals that are driven on the subpixels 122 by the source drivers 114 to update the display panel 120. For example, the display driver 230 may be configured to decompress, scale, perform image processes, and adjust the gamma levels of the display data to generate the subpixel data signals. In one embodiment, input display data (e.g., RGB codes) may be correlated with the subpixel data signals. For example, the luminance of the subpixels corresponding to the codes may have a power law response (e.g. a Luminance Gamma Curve) of approximately 2.2. Each display panel may be tuned in production to achieve an appropriate Gamma response to RGB codes and also be tuned to maintain a constant white balance (e.g. ratio of luminance of each type of subpixel to total luminance).

In one embodiment, the display data includes a code value for each subpixel 122. The code value corresponds to a brightness level for each subpixel 122 in an associated display frame (or image update). In one embodiment, the code values are in a range of 0 to 255, where 0 is a minimal brightness level and 255 is a maximum brightness level. The minimal brightness level may indicate that an associated subpixel is turned off and the maximum brightness level may indicate that the associated subpixel is a fully on state. In other embodiments, other code values may be utilized (e.g., 8 bit codes, 10 bit codes, etc.). In one or more embodiments, the luminosity for each subpixel type (e.g., red subpixels, blue subpixels, and green subpixels) may vary depending on the white point and/or gamma value.

The code value for each subpixel may be converted by the display driver circuitry 112 into a subpixel data signal that is driven onto an associated one of the subpixels 122 to update the subpixels 122. The subpixel data signal may be a voltage signal, and converting the code value may include generate a data signal (e.g., a subpixel data signal) having a particular voltage value. For example, in one or more embodiments, where a display panel utilizes SPR(Sub Pixel Rendering) such that there are more RGB pixel values than subpixels (e.g. only 2 sub pixels per pixel), more than one pixel RGB value may be used to determine the luminance of a subpixel. For uniform RGB images that are used to calibrate and evaluate sensors (e.g. grey code levels, or flat color levels, with equal RGB values on every pixel) the combination does not have a significant effect on the majority of the display panel; however for determining burn-in effect on a panel from arbitrary images, the effect of the above combination of values on the driven subpixel luminance is considered.

In various embodiments, the display device 100 is an OLED display device, and may experience aging, where the brightness of the subpixels decreases after a period of time. For example, in one embodiment, the OLED subpixels may experience a decrease in brightness after about 1 to about 1000 hours of usage at full or maximum brightness. The maximum brightness may correspond to the highest brightness level of the display device (e.g. the maximum code at full duty cycle). In other embodiments, the maximum brightness may be less than the highest brightness level for a subpixel 122, such that the maximum brightness level is about 99% or less of the highest brightness level for the subpixel. In one embodiment, a subpixel 122 may be determined to have been driven at a maximum brightness level in response to the subpixel being driven with a brightness value that is at least about 80% of the highest brightness value. In other embodiments, other percentages, greater than or less than 80% may be utilized. As the OLED subpixels age and experience a decrease in brightness, the image updated on the display panel 120 may include one or more abnormalities. For example, in an OLED subpixel that has aged, the brightness (e.g. luminance) of the OLED subpixel will be less than expected, causing visible artifacts within the displayed image. As is discussed above, the brightness level that each OLED subpixel is driven to may correspond to a code value. However, as the maximum brightness of an OLED subpixel decreases, the actual brightness level of an OLED subpixel may differ from what is expected according to associated code value and surrounding subpixels resulting in in visible patterns of bright and dark colors. A subpixel 122 that is experiencing a decrease in brightness may be referred to as experiencing burn-in.

In various instances, the display panel 120 may include additional circuitry that may be utilized to determine whether or not the brightness of an OLED pixel has decreased (e.g. a constant luminosity). In one or more embodiments, display panel 120 may include additional circuitry to measure subpixel current of each subpixel 122. For example, the subpixel circuitry 260 may include one or more switches configured to couple a subpixel 122 with measurement circuitry of the display driver 110. Further, in some instances, an operating system running on a host device that includes the display device 100 may be configured to alter an image output on the display device 100. However, such an embodiment may not be able to compensate for each individual subpixel which may lead to noticeable artifacts in the output image. In some embodiments, tracking how often a subpixel is driven to maximum brightness (or a percentage of maximum brightness), e.g., due to SPR processing contrast enhancement, or emission control circuitry, may allow the display driver 110 to perform compensation at the subpixel level. Thus, for each individual subpixel 122, as the subpixel experiences a reduction in brightness (e.g., burn-in) how the subpixel is driven may be updated.

The display driver circuitry 112 may statistically track each time each subpixel 122 is driven with the maximum and/or other brightness value, and determine when each subpixel 122 will experience reduced brightness and/or the amount of reduction in brightness. For example, the display driver circuitry 112 may determine a statistical estimate of how long each subpixel 122 has been driven with a maximum and/or other brightness values for a period of time. Further, in various embodiments, counters (e.g., counters 118) may be used to determine when each subpixel 122 is experiencing a reduced brightness, e.g., burn-in, and how much the brightness may have been reduced. In one embodiment, the amount that the brightness for a subpixel 122 has been reduced may be weighted depending on the subpixel type (e.g., a red subpixel, a green subpixel, or a blue subpixel, among others), the estimated local temperature of the pixel on the display panel while the display panel is driven at high brightness, a DBV (Digital Brightness Value) which may adjust the Gamma or emission control duty cycle of the panel, and any previously estimated burn-in effect or compensation. In one or more embodiments, a fraction of the subpixels 122 of the display panel 120 may be sampled in each display frame or in multiple display frames.

In one more embodiments, during any single display refresh or series of refreshes (e.g. 1 to 10 refresh frames) a fraction of the subpixels may be sampled, such as a display line (e.g. a row corresponding to a gate driver) or multiple display lines. Each of the sampled subpixels may be compared to a threshold code value (e.g., a representative value for the luminance of that subpixel for the sampled frame). In various embodiments, the above statistical selection of subpixels is uniform. One example statistical method of selection is a uniform random number generator such that each subpixel or group of sampled subpixels has an equal chance of selection. Another statistical method of selection is uniform sampling by sequential selection such that each subpixel or group of sampled subpixels is selected in series until the entire display frame is sampled.

In one or more embodiments, two or more statistically uniform sampling methods may be effectively combined in an example where the first line of sampling within a display device is selected by a uniform random number (e.g. an appropriately seeded pseudo random number may also be used). However, for the rest of the display frame (e.g. one line each frame for 1920 frames), each display line is selected once (e.g. uniformly) rolling over at from the edge of the frame to the opposite edge. Similarly, the comparison value (e.g. representative of luminance for each subpixel) may be statistically selected, but the same comparison for every subpixel in the uniformly sampled subpixels may be used until every display line (e.g. every subpixel) of the display has been compared once. In various embodiments, the statistically generated comparison value (e.g. used to compare all of the subpixels on a frame) is typically not uniform, and the likelihood of comparisons may be statistically selected to match the luminance (e.g., a Gamma power law) curve corresponding to the accumulated burn-in effect of that code over a series of frames.

In one or more embodiments, if a sequential 16 display lines (e.g., with a randomly selected starting display line) of RGB subpixels are sampled every display refresh (e.g., at 60 Hz) then 960 display lines are compared with a threshold value every second and in 2 seconds 1920 lines (almost 4 million subpixels) of the display are sampled. In one embodiment, if an 8 bit code is utilized for sampling 250 full frames of subpixels having a 2.2 gamma, then the lowest code compared might be 36 and only once, while the next lowest code sampled might be 51 once, then 60 once and so on up to code 255 which accumulates the full 250 into a counter as shown in the Table 1 of FIG. 7.

In one or more embodiments, the accumulation of comparisons for a frame of data is only 1 bit per subpixel, and that data which is accumulated sequentially may be stored in memory until it can be written to non-volatile memory. Further, short term effects on luminance (e.g., DBV, temperature, etc.) may be included in the statistical comparisons so that the pixels with the fastest burn-in (e.g., maximum luminance with the highest duty cycle at the worst temperature) accumulate in a counter the maximum number of true comparisons. For example, if 8 bits are used to accumulate the sampled comparisons for each subpixel then the uncompressed size would be comparable to a full frame buffer (e.g. 1 byte per subpixel) every 8 minutes of screen time. Even in embodiments where comparison samples are lost it is only for a short duration (e.g. seconds). The percentage accuracy of the statistically estimated accumulated luminance however increases with time and the number of samples. At a longer time scale, the accumulated burn-in may be scaled by other parameters, the effect of burn-in on different types of subpixel (e.g., RGB) estimated, and compressed so that further data may be accumulated and compensation of the burn-in may be made. Other significant parameters may include any already accumulated burn-in for a pixel which reduces its luminosity, as well as any compensation applied by burn-in or DeMura algorithms.

In one or more embodiments, the display driver 110 includes counters 118. In such embodiments, each subpixel 122 is associated with a respective one of the counters 118. The value of each counter 118 may correspond to an "age" of an associated one of the subpixels 122. For example, the value of each counter 118 may be increased each time an associated one of the subpixels 122 has been detected to have been driven at a predetermined brightness level. The statistical change that a counter is increased may depend on the subpixel data signal (e.g., data voltage) and one or more of a subpixel type, counter size, etc.

In one or more embodiments, the counters 118 are updated based on the operating temperature of the display panel 120. For example, the likelihood that the values of the counters 118 may be increased when the operating temperature of the display panel 120 increases exceeds a threshold temperature. Further, the likelihood that the values of the counters 118 may be increased when the operating temperature of the display panel 120 exceeds a threshold temperature for a threshold period of time or a spatially distributed map of estimated temperatures may be used to adjust the comparison threshold across subpixels in different regions of the display device. The threshold temperature may be in a range of about 25 degrees Celsius to about 80 degrees Celsius or more. Further, different subpixel types (colors) may have different thresholds at different temperatures and different probabilities of implementing a corresponding counter 118. Further, the threshold period of time may be about 5 seconds to about 60 seconds, or more. In one embodiment, the counters 118 of the selected subpixels 122 are updated based on a threshold data voltage (e.g., brightness value of a subpixel data signal) which may depend on a temperature and the subpixel type. The threshold data voltage may be stored non-linearly interpolated within a lookup table (LUT) to calculate the likelihood of a threshold comparison value over the sampled frames of subpixels.

In one or more embodiments, a range of luminosity values (e.g., display brightness codes, display voltages, etc.) is sampled for each subpixel 122. For example, the range of luminosity values may be sampled according to a change in brightness (e.g., ratio of a change in luminosity to a change in frequency). Further the sampling rate may be stored in a LUT. The sampling rate may depend on one or more of temperature, a display brightness value (DBV), DeMura compensation, RGB, and accumulated counter value.

In one embodiment, the value of each counter 118 corresponds to a number of times that the data signal driven on an associated subpixel 122 has been determined to exceed a threshold value. The threshold value may correspond to a percentage of a maximum brightness value to be sampled as part of a distribution of thresholds. For example, if a maximum brightness value corresponds to a code value of 255, the threshold value may be set to a code value of 255 or a fraction of 255 (e.g., 240, 192, 128, or 64, among others). In one embodiment, the thresholds may vary over a range from about 64 to about 255.

In one embodiment, the probability that the value of the counters 118 of the selected subpixels 122 will increase corresponds to the respective code value (brightness value). For example, as the code value increases, the probability that the value of counter 118 also increases. In one embodiment, sampling of subpixels 122 having brightness levels that satisfy a first threshold may be sampled at a higher rate than that of subpixels 122 having brightness levels that do not satisfy the first threshold and satisfy second threshold having a lower value than the first threshold. In one embodiment, for higher code values, the probability that the value of the counters 118 will be increased may vary less than that of lower code values. In one or more embodiments, the probability that the value of the counters 118 of the selected subpixels 122 will be increased may be varied, such that in different embodiments, different code values may have different corresponding probabilities to increase the value of the counters 118.

The threshold value may vary from display frame to display frame. In one embodiment, the value of the threshold may be increased and/or decreased from display frame to display frame. In one embodiment, the value of the threshold is varied about a first code value.

In one embodiment, the display driver circuitry 112 compares the code value for each subpixel or a statistical sample to a brightness threshold value. The result of the comparison may be provided to the counters 118, where the counter associated with each subpixel is increased in response to an associated data signal satisfying the brightness threshold value. In one embodiment, satisfying the brightness threshold value includes meeting and/or exceeding the threshold value. In one embodiment, the counters 118 may be referred to as local counters and may be stored in a random access memory (RAM) of the display driver 110. Further, the accumulated sums may be decimated and/or statistically sampled before being transferred and compressed in a memory external to the display driver 110. For example, the external memory may be one of a non-local RAM or a non-volatile memory (NVM), among others.

In one or more embodiments, a portion of the subpixels 122 may be examined or sampled during each display frame to reduce the amount memory utilized to store the sampled data or counter values accumulated during each display frame. In one embodiment, the statistical selected subpixels may include a sequential series of subpixels (e.g., display lines, columns, blocks, etc.). Additionally, or alternatively, the statistical selected subpixel may be a pseudo random series of neighboring subpixels. In one or more embodiments, each of the subpixels 122 is uniformly sampled over a predetermined period of time. In one embodiment, the use of a pseudorandom selection of subpixels does not require that the sequential state of sampling is tracked to ensure that sampling is uniform. However, in various embodiments, if the sequential state is reiterated each time subpixel data is recorded then sequential sampling may also be uniform. In various embodiments, comparing the subpixel data signals and/or codes of a subpixel 122 to a maximum brightness threshold or any other brightness threshold may be referred to as examining the subpixels.

In one embodiment, to determine which subpixels 122 are examined during each display frame a pseudorandom number may be assigned to each subpixel grouping. The subpixel groupings may include any grouping of subpixels 122. For example, the subpixel groups may include one or more display lines, columns, blocks of subpixels, or any other grouping of neighboring or non-neighboring subpixels. For example, the statistical generator 116 may be configured to generate a pseudorandom number for each subpixel grouping. In one embodiment, the statistical generator 116 may generate a pseudorandom number to select each subpixel grouping or groupings and a pseudorandom number for each subpixel 122 of the subpixel grouping or groupings.

The counters 118 may be an 8 bit counter. In other embodiments, counters of other sizes may be utilized. Further, larger counters may provide a high resolution of the burn-in effect. In one or more embodiments, where NVM may have a limited number of write cycles, the counter may be split into multiple smaller counters (e.g. 4 counters of 6 bits may replace an 8 bit counter) to reduce the number of writes per counter. In one embodiment, the counters 118 may be stored within a memory (e.g., memory 320 of FIG. 3) on the display driver 110. In other embodiments, the counters 118 may be stored within a memory on the host device (e.g., the memory 312 of the host device 310 of FIG. 3). The memory 320 may be a RAM or any other type of memory. The memory 312 may be a RAM, flash memory, or any other type of memory. In one embodiment, the memory 312 includes a RAM and a flash memory or any other NVM. In one or more embodiments, the counters 118 may be accumulated and then reset, e.g., zeroed, in response to transferring the accumulated value of the counter 118 from the memory 320 to the memory 312. Once the counters 118 have been reset, the counters 118 may begin incrementing again. In one embodiment, the value of the counters 118 are decimated or statistically sampled before the counter values are transferred. In one or more embodiments, the memory 312 of the display driver 110 is reset each time the display driver 110 and the display device 100 is powered off. Thus, transferring the counter values to a memory external to the display driver 110 ensures that the counter values will not be lost when the display driver 110 is powered off.

In various embodiments, the display driver 110 is configured to adjust the subpixel data signals in response to a determination that the brightness of a subpixel has been reduced beyond a threshold amount. In one embodiment, the determination is based on a value of the counter for each subpixel. For example, when the value of a counter 118 exceeds counter threshold value, a determination that the corresponding subpixel is experiencing a reduction in brightness may be made. In one embodiment, the counter threshold value may be the maximum value for the counter. For example, once the counter reaches the maximum counter value, a determination that the corresponding subpixel is experiencing a reduction in brightness may be made. In one embodiment, the maximum value of the counter may be 8. In other embodiments, the maximum value may be other values. Further, in one or more embodiments, multiple thresholds having different levels of adjustment may be utilized.

The display driver 110 may be configured to alter the subpixel data signals in response to the counter value satisfying the counter threshold value. In one embodiment, the display driver 110 "overdrives" the subpixel 122, increasing the voltage level of the corresponding subpixel data signal to compensate for any reduction in brightness of the subpixel 122. In one or more embodiments, overdriving the subpixel 122 may correspond to driving a corresponding data line to increase luminosity by changing the drive code (e.g., offsetting the code) or by adjusting the gamma value of each subpixel corresponding to the amount of adjustment to be applied to the subpixel. Accordingly, the brightness of the subpixel 122 is also increased. In one embodiment, the source driver 114 is configured to overdrive the corresponding subpixel 122. Further, the amount that the subpixel 122 is overdriven may be determined by the display driver circuitry 112. In one embodiment, the subpixel 122 is overdriven by about 2% to about 8%. In one embodiment, the subpixel 122 may be overdriven by different amounts.

In one or more embodiments, the display driver 110 reduces a value of a subpixel data signal (e.g., under-drives or dims) driven on each of the subpixels 122 in response to one or more counter values satisfying a counter threshold. For example, the display driver 110 under-drives the subpixels 122 by different amounts based on the number of subpixels 122 that have counter values that satisfy the counter threshold. In one embodiment, as the number of subpixels that have counter values that satisfy the counter threshold increases, the amount that the display driver 110 under-drives the subpixels 122 also increases. The display driver 110 may under-drive the subpixels 122 by about 2% to about 8%. In other embodiments, the display driver 110 may under-drive the subpixels 122 by other amounts. In one embodiment, a code value of 255 may correspond to a maximum brightness of a subpixel. However, as the subpixel experiences reduced brightness, the actual brightness of the subpixel when driven with a subpixel data signal corresponding to a code value of 255 may be less than the initially desired maximum brightness of the subpixel. Thus, by decreasing the luminosity level of the subpixel, the actual brightness of the subpixel may be matched to the brightness value of one or more surrounding subpixels and visible brightness differences may be reduced.

In one or more embodiments, multiple counter thresholds may be utilized to determine various levels of reduction in brightness for a subpixel 122. For example, a first counter threshold may correspond to a first reduction in brightness and a second counter threshold may correspond to a second reduction in brightness. In other embodiments, more than two counter thresholds may be utilized. Further, the display driver 110 may be configured to overdrive a subpixel by different amounts based on whether not the first and/or second counter threshold is satisfied. For example, the display driver 110 may be configured to overdrive a subpixel by a first amount when the corresponding counter satisfies a first counter threshold and a second amount when the corresponding counter satisfies a second counter. In one embodiment, the first amount is less than the second amount. For example, the first amount may be in a range of about 1% to about 5% and the second amount may be in a range of about 2% to about 8%. However, in other embodiments, other values may be utilized.

As is discussed above, the subpixels 122 may include different subpixel colors (or types). In one embodiment, each subpixel color may have a different maximum brightness threshold and/or different counter thresholds. For example, as blue subpixels may experience a reduction in brightness before red and/or green subpixels, the maximum brightness threshold for blue subpixels may have a lower value than that of red and/or green subpixels, or may be sampled more often, such that the blue subpixels counters 118 increment at a higher rate and the blue subpixels may be overdriven before the red and/or green subpixels. In other embodiments, green subpixels may experience a reduction in brightness before red subpixels; as such the maximum brightness threshold for green subpixels may have a lower value than that of red subpixels such that the green subpixels are overdriven before the red and/or green subpixels. Further, the counter threshold may differ from subpixel color to subpixel color. For example, counter threshold or thresholds applied to blue thresholds may be lower than that of red and/or green subpixels. As such, blue subpixels may be adjusted before red and/or green subpixels. Further, a counter threshold or thresholds applied to green thresholds may be lower than that of red subpixels. As such, green subpixels may be adjusted before red subpixels. In one embodiment, the size of the counters 118 for the different colors of the subpixels may differ. For example, red subpixels may have larger counters than that of green and/or blue subpixels for greater accuracy.

In one embodiment, the effective over-driven voltage or the under-driven voltage may have different dependencies on the value of the counter 118 depending on the type of associated subpixel type such that the same counter value for a blue subpixel may have a similar effect on a red or green subpixel. Further, in one or more embodiments, the luminance change on a subpixel due to burn-in may not be proportional to each of the different luminance values (e.g., codes) and different luminance values (e.g., codes) may be adjusted differently to adjust for burn-in.

In various embodiments, different subpixel colors may be adjusted (e.g., overdriven) by different amounts. For example, red and/or blue subpixels may be overdriven by larger percentages than that of green subpixels.

Figure 3:
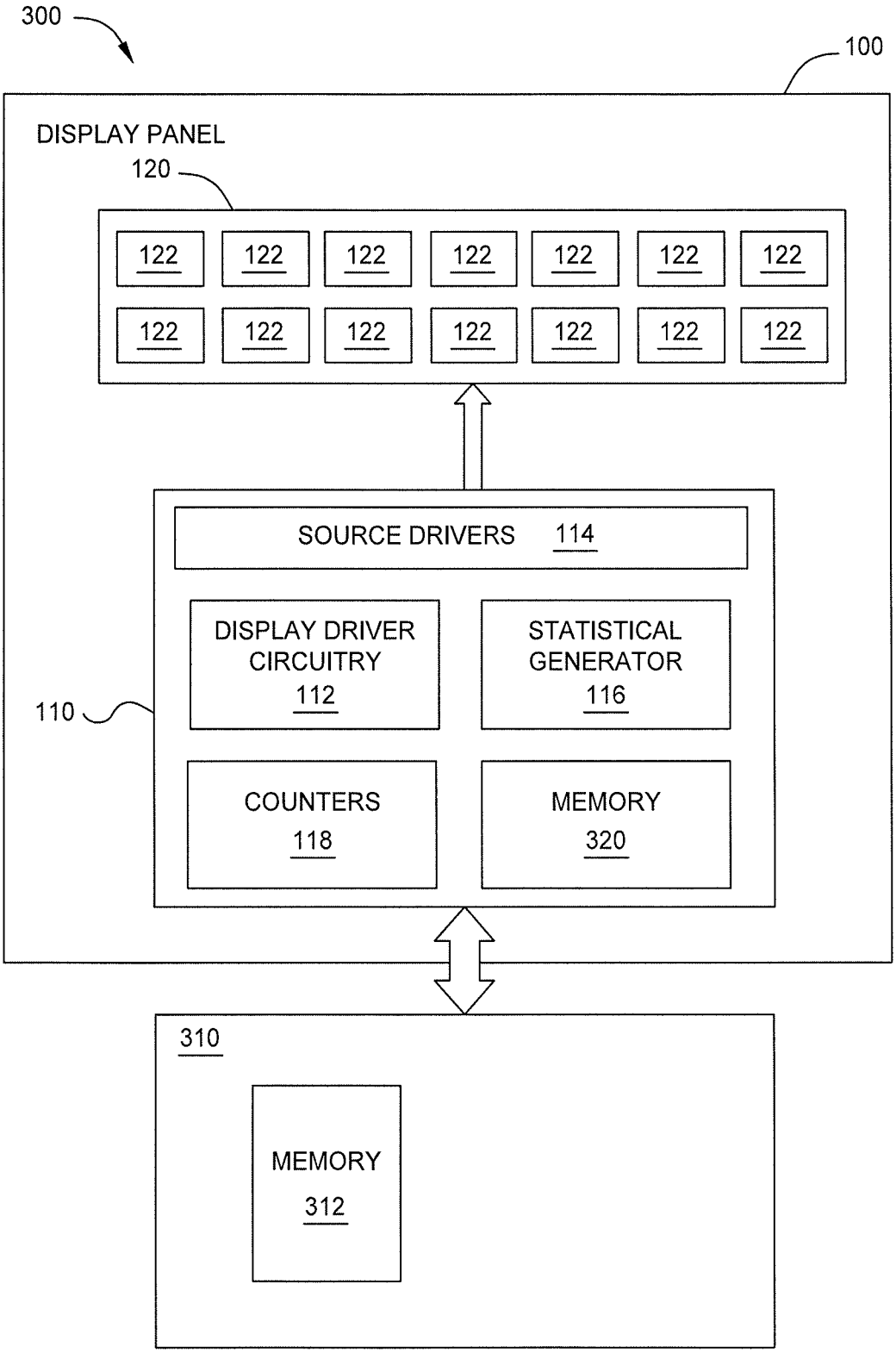
FIG. 3 is a schematic block diagram of an electronic device, according to one or more embodiments.

FIG. 3 illustrates an example electronic device 300 including the display device 100 and a host device 310. The host device 310 may be a central processing unit (CPU) of the electronic device 300. In other embodiments, the host device 310 may be one or more other processors (e.g., a graphics processing unit (GPU) or other processing units) of the electronic device 300. The electronic device 300 may be any type of computing device. For example, the electronic device 300 may be a personal computer, a mobile phone, or a tablet device, among others. As is illustrated, the host device 310 is communicatively coupled to the display driver 110. In one embodiment, the host device 310 outputs display data to the display driver 110 which converts the display data into data signal utilized to update the display panel 120. In one embodiment, the display driver 110 communicates data corresponding to the counters 118 to the host device 310 to be stored in the memory 312.

In one or more embodiments, the electronic device 300 includes the memory 312 and communicates DeMura data (e.g., compressed DeMura adjustment data). through display receiver circuitry of the display driver 110. In one embodiment, the DeMura data is sent to the DeMura memory (e.g., the memory 320) in the display driver 110. The DeMura data may also incorporate burn-in adjustment data based on the counter values within the memory 312. In one embodiment, incorporating the burn-in adjustment data within the DeMura data includes decompressing and re-compressing the burn-in adjustment data.

In various embodiments, even though the amount of memory that may be needed to store the counters 118 may be reduced by decreasing the size of the counters 118 and only examining a portion of the subpixels 122 per display frame, the display driver 110 may not include enough memory to store the counter 108 with sufficient resolution to not cause any visual effects within the display device 100. Thus, in one embodiment, the counters 118 may be compressed.

In one embodiment, the counters 118 are stored within a buffer. Each display line (e.g., row of subpixels) of the display panel 120 may correspond to a different line, group of lines, or block in the buffer. Further, each line in the buffer may be individually compressed. In such an embodiment, as counter values for different subpixels are updated, only those lines of the buffer that include a subpixel with an updated counter value may be decompressed. As such, only those lines of the buffer that correspond to display lines having a subpixel that are examined are decompressed such that the associated counter values may be updated. After the counter values are updated the buffer lines may then be compressed.

In one embodiment, the buffer may be stored within the memory 312 of the host device 310. In such an embodiment, the display driver 110 may only communicate the portion of the buffer that was updated. In one embodiment, the display driver 110 may communicate updates to the host device 310 after each display frame, after a plurality of display frames, after a period of time has elapsed, or at power down of the display device 100 (e.g., sleep-out request). In one embodiment, the statistical accumulation period of time may correspond to about 1 second. In other embodiments, a period of time of other lengths may be utilized.

In another embodiment, the buffer may be stored within the memory 320 of the display driver 110. In one embodiment, memory 320 is a flash memory and the buffer may be stored within the memory 320. The buffer may be stored as an image within the memory 320 an updated after a period of time has elapsed or at power down of the display device 100. In one embodiment, the display driver 110 may update the buffer within memory 320 once an hour. In other embodiment, the display driver 110 may update the buffer within memory 320 every one or more minutes. Further, time periods greater than an hour may be utilized to update the buffer. In one embodiment, the display data may also include one or more seed values to be utilized by the statistical generated for random number generation or a sequence generation for sequential sampling of the subpixel 122.

In one or more embodiments, a fix length compression scheme may be applied to the counters 118, reducing the memory size of the counters. In one or more embodiments, a low spatial frequency baseline in conjunction with a compression (e.g., an encoding such as Huffman coding or Arithmetic coding) technique may be applied to the counter values to compress the counter values.

Figure 4:
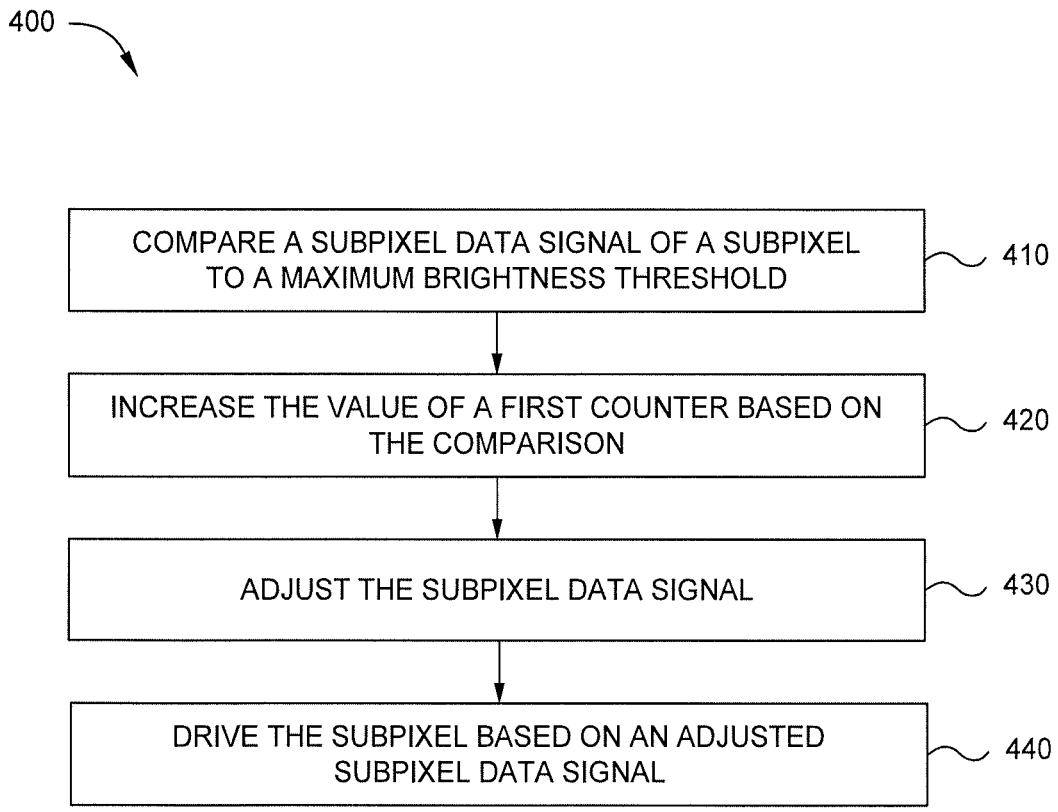
FIG. 4 illustrates a flow chart of a method for determining subpixel data signals, according to one or more embodiments.

FIG. 4 illustrates a method 400 for updating a display device and compensating for effects of reduced brightness of subpixels within a display device. In one embodiment, the display driver 110 receives display data, and the display driver circuitry 112 processes the display data to determine subpixel data signals to be driven on each of the subpixels 122. The display driver 110 further communicates the subpixel data signals to each source driver 114. In one embodiment, the display data may be provided by the host device 310.

At operation 410, a subpixel data signal is compared to a brightness threshold. In one embodiment, the display driver 110 is configured to compare a subpixel data signal driven on a first subpixel of subpixels 122 to a brightness threshold to determine if the subpixel is driven to a threshold brightness or a percentage of the maximum brightness. The display driver circuitry 112 selects one or more of the subpixels 122 or subpixel groupings to be examined based on one or more statistically uniform numbers (e.g., pseudo random or sequential numbers) provided by the statistical generator 116. A selected subpixel 122 may be referred to as statistically selected subpixel. Examining a subpixel may include comparing the associated subpixel data signal to the threshold brightness value. In one embodiment, different thresholds may be set for different groups of subpixels (e.g., red subpixels, green subpixels, and blue subpixels), subpixel locations, and/or accumulated counter values, etc.

In one embodiment, the statistical generator 116 instructs which subpixel 122 selected by display driver circuitry 112 for examination. Further, the statistical generator 116 may communicate the statistical thresholds associated with the subpixels to be selected to the display driver circuitry 112. In one or more embodiments, the statistical generator 116 selects the subpixels to be examined for each display frame. During each display frame less than all of the subpixels 122 may be examined. In one embodiment, during each display frame about 30 to about 3000 subpixels are examined. In other embodiments, less than 30 subpixels, or more than 3000 subpixels but less than all of the subpixels of the display panel may be examined. In one embodiment, not every frame is examined in a statistically uniform way. In one or more embodiments, the statistical generator 116 selects subpixels based on a sequence number provided by a host device (e.g., host device 310). Further, in one or more embodiments, the statistical generator 116 selects one or more subpixels based on a randomly generated sequence.

In one embodiment, the display driver 110 randomly selects which subpixel groupings of the display panel 120 are examined. For example, during each display frame different display lines, columns, or blocks and corresponding subpixels may be randomly selected. In one or more embodiments, a lookup table or shift register may be utilized to identify the display line or lines and corresponding subpixels for examination.

At operation 420, a value of a counter corresponding to the subpixel is increased based on the comparison of the subpixel data signal with the maximum brightness threshold. For example, the display driver 110 may increase the value of a counter of counters 118 associated with a subpixel being examined in response to the subpixel data signal of the subpixel satisfying the threshold. In one embodiment, satisfying the threshold includes meeting and/or exceeding the value of the threshold selected for the current frame.

At operation 430, the subpixel data signal is adjusted. For example, the display driver 110 or the host device 310 may adjust the subpixel data signal in response to the value of the corresponding counter satisfying a counter value threshold. Adjusting the subpixel data signal may include increasing or decreasing a voltage level, a code, and/or a gamma value of the subpixel data signal. In one embodiment, the voltage level of the subpixel data signal is increased by about 1% to about 10%. In one embodiment, the display driver circuitry 112 instructs the source drivers 114 to overdrive an associated one of subpixels and by how much to overdrive the subpixel based on a counter value associated with a subpixel or under-drive a subpixel based on a counter value relative to the counter value associated with the subpixel.

At operation 440, the subpixel is driven with the adjusted subpixel data signal. In one embodiment, a source driver 114 coupled to associated one of the subpixels 122 may overdrive the subpixel such that the brightness of the subpixel is increased.

Figure 5:
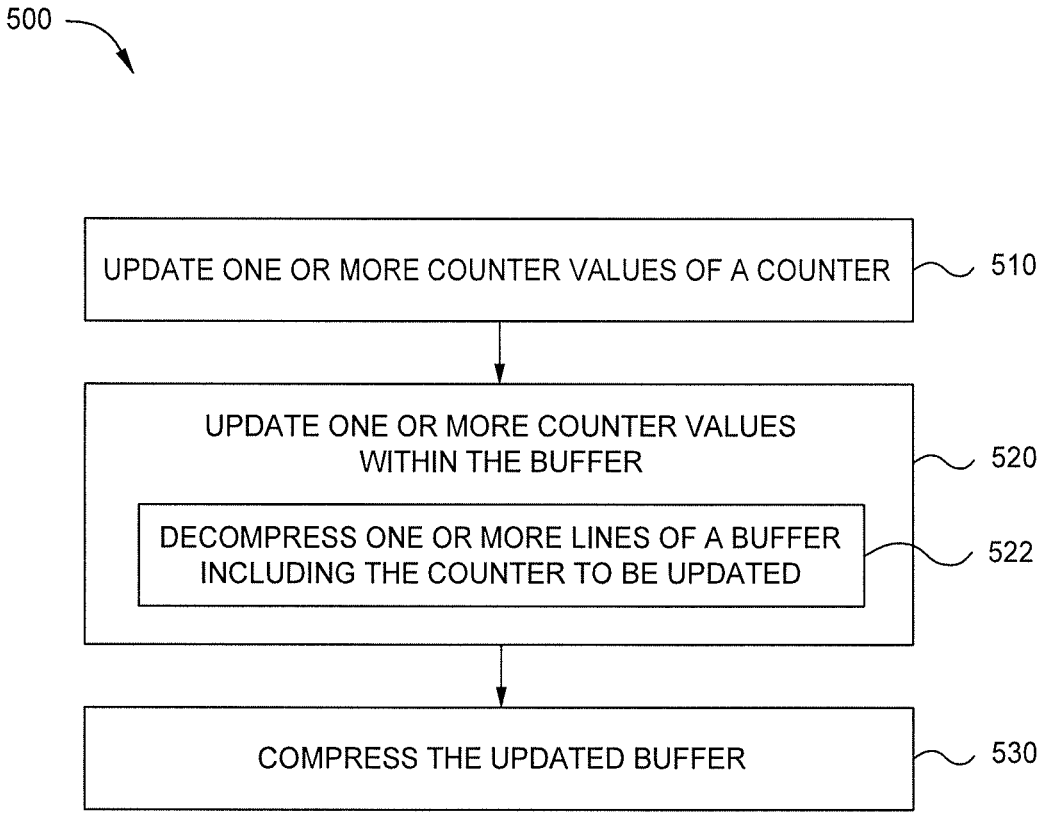
FIG. 5 illustrates a flow chart of a method for storing updated counter value according to one or more embodiments.

FIG. 5 illustrates a method 500 for determining how often a subpixel is driven at a maximum brightness, according to one or more embodiments. At operation 510, a counter value of a counter is updated. In one embodiment, display driver circuitry 112 updates a counter value of a first counter of counters 118.

In various embodiments, the counters 118 are stored within a buffer, wherein each line of the buffer corresponds to a respective display line of the display panel 120.

At operation 520 the counter value or values associated with the selected subpixels are updated within the buffer. In one embodiment, the display driver 110 communicates the updates to the host device 310 which are stored within memory 312. The updates may include the counters and corresponding updated values. In another embodiment, the display driver 110 updates a memory 320 within the display driver.

In one embodiment, the line or lines of the buffer including a counter to be updated are decompressed before the updated counter value or values can be stored. For example, at operation 522 one or more lines within the buffer are decompressed. In one embodiment, the lines of the buffer correspond to display lines comprising at least one of subpixels that have been selected for examination. Further, in one embodiment, the display driver 110 may instruct the host device 310 to decompress the corresponding lines of the buffer, transfer the updated counters and corresponding values to the host device 310, and instruct the host device 310 to update the updated counters. In another embodiment, the display driver 110 decompress the corresponding lines of the buffer stored within memory 320, and updates the counters within decompressed lines.

At operation 530, the updated buffer is compressed. For example, the host device 310 may compress the decompressed lines of buffer stored within memory 312 after the counters are updated. In other embodiments, the display driver 110 may compress the decompressed lines of buffer stored within memory 320 after the counters are updated.

Figure 6:
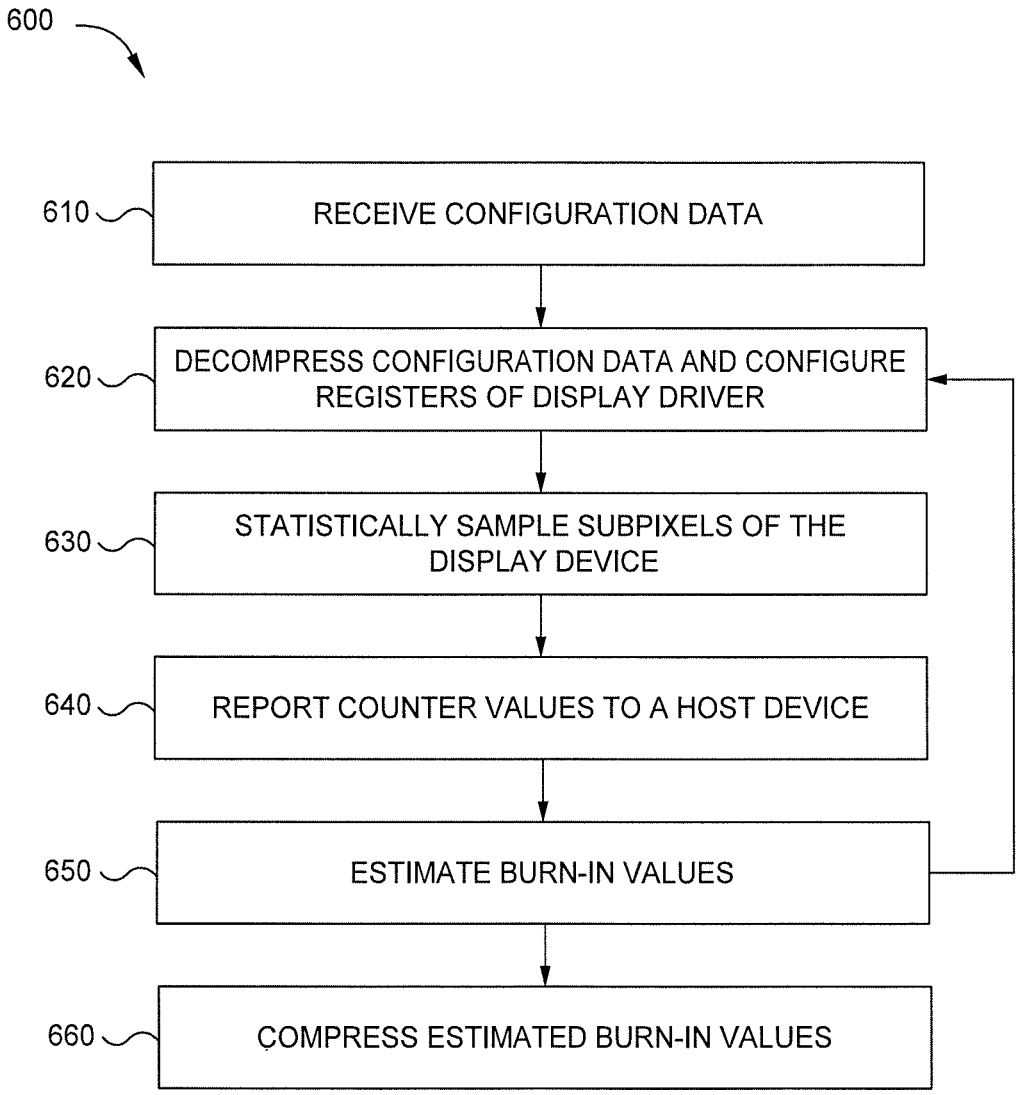
FIG. 6 illustrates a flow chart of a method for updating a display, according to one or more embodiments.

FIG. 6 illustrates a flow chart of a method 600 for operating a display device, according to one or more embodiments. At operation 610, configuration data is received. In one embodiment, the display driver 110 receives the configuration data from the host device 310. The configuration data may be compressed and transmitted over a display receiver interface (e.g., MIPI interface) from the host device 310. In one embodiment, the configuration data may include one or more of temperature data, DBV, gamma value, white point value, frame rate, and statistical sampling data. Operation 610 may occur in response to a sleep-out event or a power-on event of the display device 100.

At operation 620, the configuration data is decompressed and used to configure the registers of the display driver. For example, the configuration data may be decompressed by the display driver 110 and loaded into the registers of the display driver 110. In one embodiment, the decompressed configuration data may be transmitted to the registers of the display over a communication link such as SPI. In one or more embodiments, the decompressed configuration data may be utilized to generate a statistical sampling LUT, the statistically selected samples, and/or a sampling period (e.g., number of display frames). In one embodiment, operation 620 occurs in response to a sleep-out event.

At operation 630, the subpixels of the display device are statistically sampled. For example, the statistically selected subpixels 122 are sampled over the sampling period. In one embodiment, the display driver 110 compares a drive luminosity for each statistically selected subpixel 122 to a statistically selected LUT to determine whether or not to increment the associated counters 118. In one embodiment, statistically sampled thresholds may be utilized. For example, the subpixels 122 having a brightness value above the statistically sampled threshold may be sampled at higher rate than subpixels 122 having a brightness value below the statistically sampled threshold. In one embodiment, the brightness value for each statistically selected subpixel 122 is compared to a statistically sampled threshold, and an associated one of counters 118 is increased when the brightness value of the statistically selected subpixel 122 exceeds the statistically sampled threshold. Further, each of the counters 118 may be accumulated over one or more sampling periods and stored within memory 320 (e.g., RAM) of the display driver 110. The statistically selected subpixels 122 may be sampled over the entire sampling period.

At operation 640, the counter values are reported to a host device. For example, the display driver 110 may report the counter values to the host device 310. In one embodiment, the display driver 110 may report the counter values to the host device 310 at the end of each sampling period or once every one or more display frames. In one embodiment, the host instructs the display driver 110 to report the counter values. The accumulated counter values may be stored within a RAM of the host device 310. Alternatively, the accumulated counter values may be stored within a NVM of the host device 310.

At operation 650, burn-in values are estimated. In one embodiment, the host device 310 may determine an estimate of the burn-in values based on the updated counter values received from the display driver 110. Further, the host device 310 may determine an estimate of burn-in based on stored burn-in data within memory 312 of host device 310 and the updated counter values. In one embodiment, the host device 310 determines an estimate of burn-in based on stored burn-in data and one or more of gamma values, luminosity values, a white point value, and temperature. An estimate of burn-in may be calculated for each subpixel and stored within a NVM of the host device 310. In one embodiment, the estimated burn-in values may be communicated to a flash memory, or any NVM, of the host device 310 via a flash write command. The estimated burn-in values may be communicated to the flash memory, or any NVM, of the host device 310 in response to a sleep-in command. In one embodiment, the updated estimated burn-in values may be communicated to the display driver 110 and utilized within operation 620.

At operation 660, the estimated burn-in values are compressed. For example, the host device 310 may utilize a visually lossless compression technique to compress the burn-in values for each of the subpixels 122. For example, the host device 310 may employ a 6 to 1 or an 8 to 1 compression technique. In other embodiments, other compression techniques having larger or smaller compression ratios may be utilized. In one embodiment, the estimated burn-in values are compressed in response to a sleep-in command. Alternatively, the estimated burn-in values are compressed in response to a power off command. Further, in one or more embodiments, the estimated burn-in values may be stored without being compress and operation 660 may be omitted.

Thus, the embodiments and examples set forth herein were presented in order to best explain the embodiments in accordance with the present technology and its particular application and to thereby enable those skilled in the art to make and use the disclosure. However, those skilled in the art will recognize that the foregoing description and examples have been presented for the purposes of illustration and example only. The description as set forth is not intended to be exhaustive or to limit the disclosure to the precise form disclosed.

In view of the foregoing, the scope of the present disclosure is determined by the claims that follow.

What is claimed is:

1. A method for updating a display device, the method comprising:

comparing a first subpixel data signal of a first subpixel of a plurality of subpixels of the display device to a first threshold;

obtaining a first line of a plurality of lines of a buffer corresponding to the first subpixel, wherein the buffer stores a plurality of counters, wherein each counter of the plurality of counters corresponds to a particular subpixel of the plurality of subpixels;

increasing, in response to the first subpixel data signal exceeding the first threshold, a value of a first counter in the first line of the buffer, wherein the first counter corresponds to the first subpixel, and wherein the first counter counts a number of times that the first subpixel exceeds the first threshold;

adjusting the first subpixel data signal in response to the value of the first counter satisfying a second threshold; and driving the first subpixel based at least in part on the adjusted first subpixel data signal.

2. The method of claim 1, further comprising:

assigning each subpixel of the plurality of subpixels with a pseudorandom number; and selecting the first subpixel based on the pseudorandom number of a first subpixel of the plurality of subpixels.

3. The method of claim 1, further comprising:

assigning one or more subpixel groupings of the plurality of subpixels with a different pseudorandom number; and selecting a first subpixel grouping of the one or more subpixel groupings comprising the first subpixel based on the pseudorandom number of the first subpixel grouping.

4. The method of claim 1, wherein the first threshold is variable.

5. The method of claim 1, wherein the buffer is part of a memory of one of the display device and a host device coupled to the display device.

6. The method of claim 1, further comprising:

determining an adjustment value based on first counter value, and compressing the adjustment value.

7. The method of claim 1, wherein each line of the buffer corresponds to a different display line of the display device and each line of the buffer is configured to be independently compressed.

8. The method of claim 1, further comprising comparing a second subpixel data signal of a second subpixel of the plurality of subpixels to the first threshold;

increasing a value of a second counter corresponding to the second subpixel in response to the second subpixel data signal exceeding the first threshold;

adjusting the second subpixel data signal in response to the value of the second counter satisfying a second threshold; and driving the second subpixel based at least in part on the adjusted second subpixel data signal and the value of the second counter.

9. The method of claim 1, further comprising:

under-driving each of at least a subset of the plurality of subpixels in response to at least one values of the plurality of counters satisfying a counter threshold, wherein the under-driving the plurality of subpixels is by an amount that is dependent on a number of values of the plurality of counters satisfying the counter threshold.

10. The method of claim 1, further comprising:

defining a plurality of thresholds each corresponding to a level of brightness reduction of the plurality of subpixels, wherein the plurality of thresholds is for the plurality of counters, wherein the second threshold is one of the plurality of thresholds.

11. A processing system for a display device, the processing system comprising display driver circuitry and configured to:

compare a first subpixel data signal of a first subpixel of a plurality of subpixels of the display device to a first threshold;

obtain a first line of a plurality of lines of a buffer corresponding to the first subpixel, wherein the buffer stores a plurality of counters, wherein each counter of the plurality of counters corresponds to a particular subpixel of the plurality of subpixels;

increasing, in response to the first subpixel data signal exceeding the first threshold, a value of a first counter in the first line of the buffer and compress the first line of the buffer, wherein the first counter corresponds to the first subpixel, and wherein the first counter counts a number of times that the first subpixel exceeds the first threshold;

adjust the first subpixel data signal in response to the value of the first counter satisfying a second threshold; and drive the first subpixel based at least in part on the adjusted first subpixel data signal.

12. The processing system of claim 11, further configured to:

assign each subpixel of the plurality of subpixels with a pseudorandom number; and select the first subpixel based on the pseudorandom number of a first subpixel of the plurality of subpixels.

13. The processing system of claim 11, further configured to:

assign one or more subpixel groupings of the plurality of subpixels with a different pseudorandom number; and select a first subpixel grouping of the one or more subpixel groupings comprising the first subpixel based on the pseudorandom number of the first subpixel grouping.

14. The processing system of claim 11, wherein the first threshold is variable.

15. The processing system of claim 11, further configured to store the value of the first counter within a flash memory of the display device.

16. The processing system of claim 11, further configured to store the value of the first counter in a memory of a host device.

17. The processing system of claim 11, wherein each line of the buffer corresponds to a different display line of the display device and each line of the buffer is independently compressed.

18. The processing system of claim 11, further configured to:

compare a second subpixel data signal of a second subpixel of the plurality of subpixels to the first threshold;

increase a value of a second counter corresponding to the second subpixel in response to the second subpixel data signal exceeding the first threshold;

adjust the second subpixel data signal in response to the value of the second counter satisfying a second threshold; and drive the second subpixel based at least in part on the adjusted second subpixel data signal and the value of the second counter.

19. A display device comprising:

a plurality of subpixels; and a display driver coupled to the plurality of subpixels, the display driver configured to:

compare a first subpixel data signal of a first subpixel of the plurality of subpixels to a first threshold;

obtain a first line of a plurality of lines of a buffer corresponding to the first subpixel, wherein the buffer stores a plurality of counters, wherein each counter of the plurality of counters corresponds to a particular subpixel of the plurality of subpixels;

increase, in response to the first subpixel data signal exceeding the first threshold, a value of a first counter in the first line of the buffer, wherein the first counter corresponds to the first subpixel, and wherein the first counter counts a number of times that the first subpixel exceeds the first threshold;

adjust the first subpixel data signal in response to the value of the first counter satisfying a second threshold; and drive the first subpixel based at least in part on the adjusted first subpixel data signal.

20. The display device of claim 19, wherein the display driver is further configured to:

compare a second subpixel data signal of a second subpixel of the plurality of subpixels to the first threshold;

increase a value of a second counter corresponding to the second subpixel in response to the second subpixel data signal exceeding the first threshold;

adjust the second subpixel data signal in response to the value of the second counter satisfying a second threshold; and drive the second subpixel based at least in part on the adjusted second subpixel data signal and the value of the second counter.

* * * * *